US005782281A

United States Patent [19]

Møller

[11] Patent Number: 5,782,281

[45] Date of Patent: Jul. 21, 1998

[54] OPENABLE WINDOW

[75] Inventor: Brent Møller, Gentofte, Denmark

[73] Assignee: V. Kann Rasmussen Industri A/S, Søborg, Germany

[21] Appl. No.: 663,224

[22] PCT Filed: Feb. 2, 1995

[86] PCT No.: PCT/DK95/00051

§ 371 Date: Jun. 17, 1996

§ 102(e) Date: Jun. 17, 1996

[87] PCT Pub. No.: WO95/21314

PCT Pub. Date: Aug. 10, 1995

[30] Foreign Application Priority Data

Feb. 4, 1994 [DK] Denmark ..... 0151/94

[51] Int. Cl.[6] ..... E06B 3/32

[52] U.S. Cl. ..... 160/92; 160/107

[58] Field of Search ..... 160/90, 92, 106, 160/107, 178.1 R

[56] References Cited

U.S. PATENT DOCUMENTS

| | | | |
|---|---|---|---|
| 2,176,683 | 10/1939 | Peremi et al. . | |
| 2,281,071 | 4/1942 | Knudsen | 160/107 X |
| 2,311,300 | 2/1943 | Dubour et al. . | |
| 3,366,159 | 1/1968 | Arnold et al. | 160/107 |
| 4,913,213 | 4/1990 | Schnelker | 160/107 |
| 5,497,820 | 3/1996 | Drake, III | 160/107 |

FOREIGN PATENT DOCUMENTS

| | | | |
|---|---|---|---|
| 215 | 2/1992 | Denmark . | |
| 155228 | 6/1995 | Denmark . | |
| 235952 | 9/1987 | European Pat. Off. | 160/107 |
| 319601 | 6/1995 | European Pat. Off. . | |

*Primary Examiner*—Blair Johnson
*Attorney, Agent, or Firm*—Lane,Aitken & McCann

[57] ABSTRACT

An openable window comprises a main frame (1) and a sash (3) top-hinged therein, in which sash is mounted a light screen, particularly a Venetian blind (4), with an adjusting mechanism (5), as well as with a screening device (7, 8) which may be an insect screen mounted in the main frame internally of the window sash. A turning handle (15) is mounted at the internal side of the screening device and is via a shaft (18) connected with the light screen adjusting mechanism in a rotationally locked manner, said shaft being articulated with the adjusting mechanism and telescopically connected with a pivotable member (14). The Venetian blind can thus be operated also with an insect screen placed internally of the window sash and with the window in an opened position for ventilation. The pivotable member can be designed as a ball joint journalled in a double conical bearing or as a ball with a through bore where the shaft is designed as a round bar being integrally with the turning handle.

14 Claims, 4 Drawing Sheets

OPENABLE WINDOW

Figure 2:
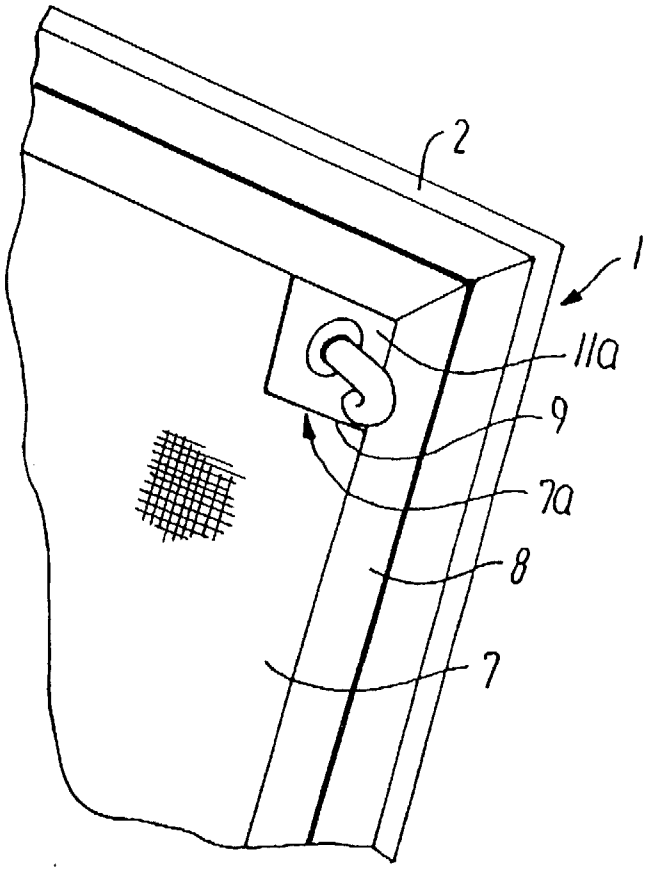

The invention relates to an openable window with a main frame and a sash top-hinged therein, in which sash is mounted a light screen, particularly a Venetian blind, with an adjusting mechanism, as well as with a screening device, preferably an insect screen adapted to be detachably mounted in the main frame internally of the sash and a turning handle mounted at the internal side of the screening device, which turning handle via a shaft is connected with the light screen adjusting mechanism in a rotationally locked manner.

From DK-A-92/00215 a spring-biased lifting system for operation of an external sunscreen for a window is known, in which an external part of a spring-biased drawbar, which is linked with an internally arranged operation turning handle, only in the closed position of the sash may be brought into engagement with a transmission device for a sunscreen which is arranged in an external housing.

From EP-A-0319 601 it is further known to operate a rolling shutter arranged externally on the wall in front of a top-hinged window by means of an internally arranged operation turning handle via a transmission comprising a conical gear at the end of the rolling bar for the shutter in engagement with the conical tooting on a bevel gear at the end of a rotatable shaft connected with the turning handle through two universal joints- This transmission which is arranged entirely outside the window sash comprises between the two universal joints an intermediate member firmly connected with a ball which for compensation of tolerances is journalled to be partly rotatable in a bearing in an internally positioned part of an end wall of the shutter housing. Thereby and through the telescopic design of the rotatable shaft the transmission may be used in the same design for different dimensions of the rolling shutter housing.

Due to the firm arrangement of the rolling shutter on the wall neither this known construction is intended to allow operation of the rolling shutter in an opened position of the window.

It is moreover not suggested in connection with any of these prior art external sunscreens to make use of an internal insect screen.

From DK-B-155 228 is known a window having a Venetian blind with an adjusting mechanism comprising a turning handle and further having an insect screen adapted to be mounted internally of the Venetian blind. In order to give access to the adjusting mechanism when the insect screen is mounted, the screen has been provided with a further turning handle carrying a flexible shaft which when mounting the insect screen is connected with the turning handle of the adjusting mechanism, and the required inclination of the Venetian blind slats can then be adjusted by turning the additional turning handle. This structure allows adjustment of the Venetian blind, also when the window sash is open, but requires operation of two different turning handles, depending on whether the insect screen is mounted or not. The two turning handles make the manufacture and maintenance of the window more expensive. Furthermore, mounting or demounting of the insect screen will be more difficult in the case where the adjusting mechanism is activated via a rod which thus has to be remounted from one turning handle to the other. Moreover, requirements are made to the screen material and the sash because the forces produced by the operation are transferred thereto.

Therefore, the object of the invention is to eliminate above mentioned drawbacks by procuring an openable window of the above referenced type where the light screen is adjusted by the one and same accessible turning handle whether the screening is mounted or not.

Consequently, the window according to the invention is characterized in that said shaft is articulated with the light screen adjusting mechanism and is axially displaceable in a bore in a pivotable member which is journalled in a bearing device connected with the main frame in such a way as to permit said shaft to pivot around an axis of rotation parallel to the hinge axis of the window sash.

The direct articulation between the shaft and the adjusting mechanism entails a simpler manufacture and fewer parts to be maintained and furthermore the light screen will be easy to operate in all angular apertures of the window sash as the pivotable bearing of the shaft combined with the articulation with the mechanism entails that bending of the shaft is avoided when the window is opened. The connection of the bearing device with the main frame ensures that the operating forces are transferred thereto without any appreciable load on the material of the screening.

In an embodiment the pivotable member is designed as a ball joint, and the bearing device comprises a double conical bearing in -a bearing shell fastened to the main frame. This provides for a good and safe bearing as well as a simple manufacture and mounting since one conical face of the bearing can be designed as an integrated part of the bearing shell and the other conical surface can be obtained by embedding a locking ring with a conical inside in the bearing shell subsequent to the insertion of the ball joint in the shell.

In another embodiment the ball joint is designed integrally with the turning handle, and the shaft has a non-circular cross section and is mounted in an axially displaceable manner in a corresponding non-circular hole in the ball joint and the turning handle. Thereby, the moments of rotation affecting the turning handle are in a simple way transferred via the ball joint to the adjusting mechanism at the same time as the shaft and the adjusting mechanism are completely decharged from transverse forces as these forces of the ball joint are transferred direct to the bearing.

The ball joint can also be designed as a spring-loaded ball socket which limits the contact pressure between the bearing and the outside of the ball joint to a level determined by the extent of the spring loading so that normal wear and tear of the bearing device is avoided and the clearance between the ball joint and the bearing remains unchanged by long-term use.

In a further embodiment which as regards manufacture is very simple, the shaft is designed as a round bar which is routed in a rotatable and axially displaceable manner through a circular bore in the ball joint designed as a solid ball and is fastened to said turning handle. This provides for a direct transmission of the turning moment affecting the turning handle to the light screen adjusting mechanism, and the turning handle will only absorb pure bearing forces.

In an alternative embodiment the pivotable member is designed as a short rotatable cylinder, the bearing device comprises two bearings connected with the main frame and with their bearing axis parallel to the hinge axis of the window sash, and said shaft is designed as a round bar which is routed in a rotatable and axially displaceable manner through a circular bore in said cylinder between the two bearings and is firmly connected to said turning handle. This design of the bearing ensures a safe and simple bearing with large bearing areas and an appropriate transmission of the driving moment without unnecessary load of the bearing. Furthermore, the rotatable cylinder can be manufactured in a simple way from a cannular or bar-shaped standard piece which is shortened into appropriate pieces and the circular bore is then drilled right through each piece.

Furthermore, the articulation between the shaft and the light screen adjusting mechanism can advantageously comprise a cardan joint which in a manner known per se transfers the forces between the shaft and the adjusting mechanism.

Figure 1:
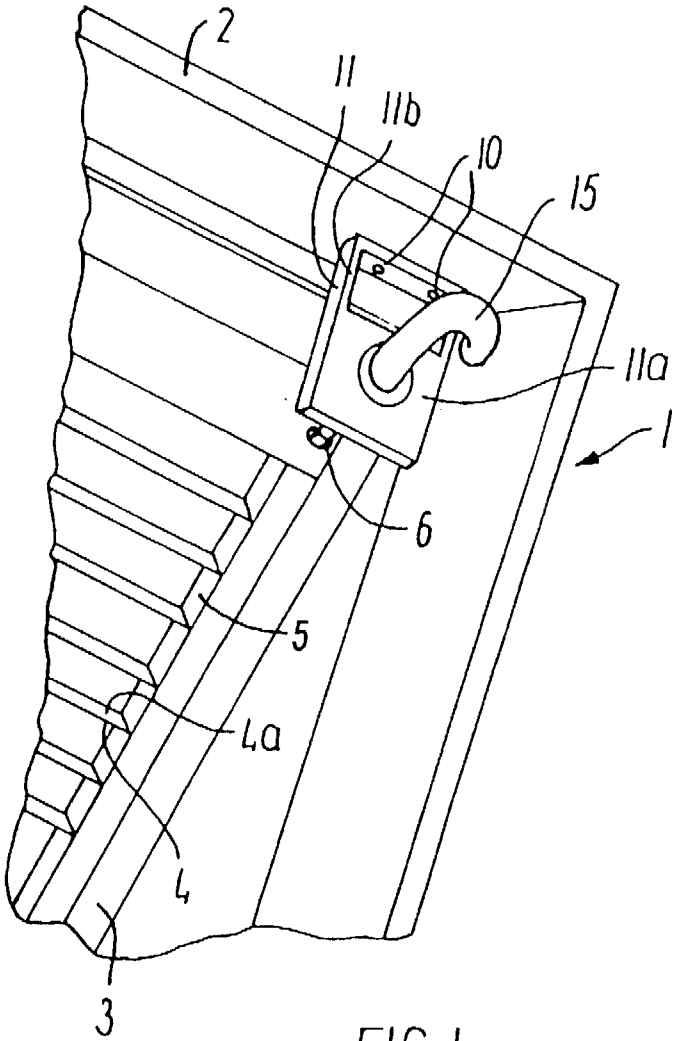

The invention will in the following be explained in detail with reference to the enclosed schematic drawing, in which FIG. 1 shows the upper right corner of an openable window according to the invention without screening, FIG. 2 the window with mounted screening device, FIG. 3 a first embodiment of a bearing device for the window, FIG. 4 on a larger scale an articulated joint at the adjusting mechanism, FIG. 5 a second embodiment of the bearing device, FIG. 6 a third embodiment of the bearing device, FIG. 7 a sectional view of the bearing in a fourth embodiment of the bearing device.

In FIG. 1 is shown a main frame 1 with a glass.30 supporting window sash 3 journalled at the top member 2 of the main frame. The sash 3 carries internally of a non-shown window glass a light screen which in the shown embodiment is a Venetian blind 4 having a mechanism 5 for adjusting the inclination of the Venetian blind slats 4*a*. The mechanism 5 comprises a rotary element 6 mounted on the internal side of the sash 3 and having the form of a bushing which when turned activates the adjustment movements of the mechanism.

A detachable screening device which can be an insect screen 7 in an edge frame 8, is in FIG. 2 shown in mounted position where the edge frame 8 is retained in the-main frame 1. The insect screen 7 has in a corner 7*a* a hole 9 adapted to receive a bracket 11 fastened on the top member 2 of the main frame by means of screws 10. In the mounted position the insect screen 7 fits tightly around two sides of the bracket 11, while the edge frame 8 blocks the other openings between the bracket 11 and the window sash 2, so that no intrusion of insects can take place.

Figure 3:
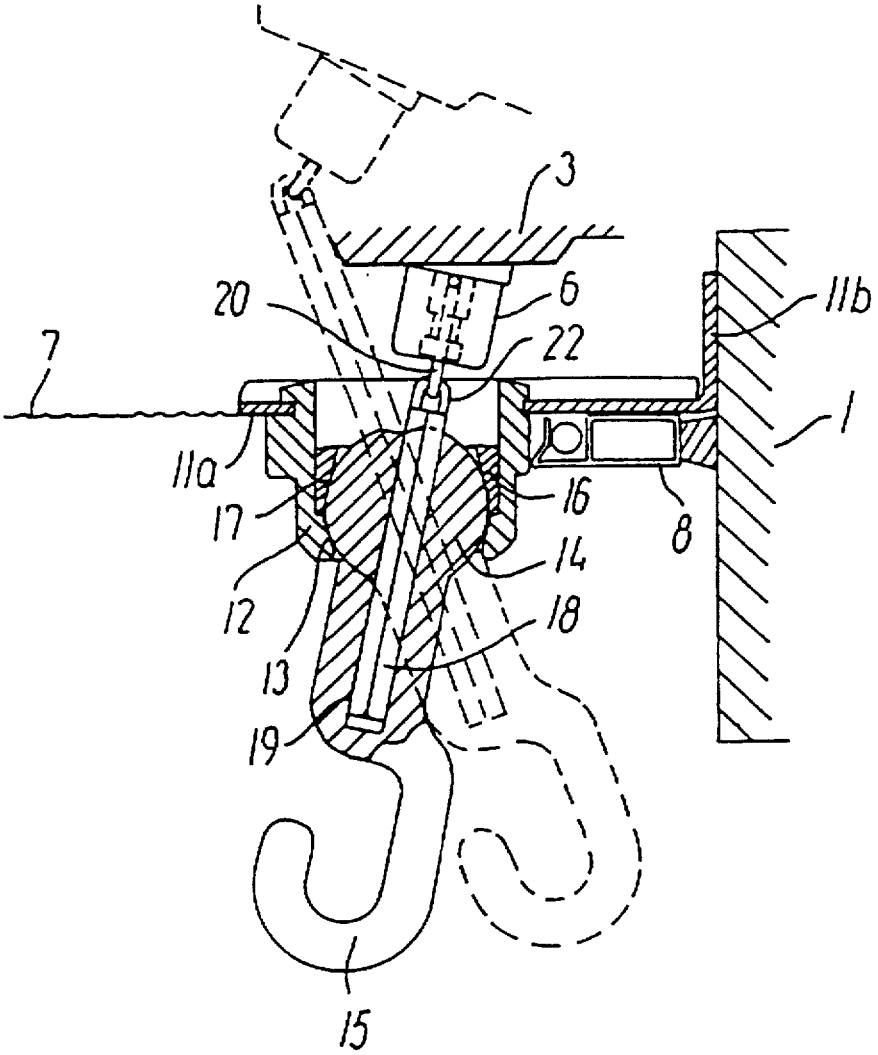

In FIG. 3 the closed position of the window is shown by a solid line and an open position is shown by a dotted line. The bracket 11 comprises a plate-formed section 11*a* being rigidly connected to a foot piece 11*b* fastened by screws to the main frame and carrying a bushing 12. The bushing 12 has on the side facing away from the window opening an internal conical ring surface 13 acting as a first bearing surface for a ball joint 14. The ball joint 14 is in the shown embodiment designed integrally with a turning handle 15, it is, however, clear that the ball joint and the turning handle may alternatively be produced as separate inter-connected parts. Further the bushing 12 has a lock ring 16 with an internal conical surface 17 forming another bearing surface for the ball joint 14.

A shaft 18 with a non-circular, for instance hexagonal cross section is axially displaceable in a corresponding non-circular longitudinal hole 19 through the ball joint 14 and the turning handle 15, and is at its end facing away from the turning handle 15 articulated with the rotary element 6 of the Venetian blind adjusting mechanism 5. When opening the window, the ball joint 14 pivots on its bearing surfaces 13, 17 in the bushing 12 around an axis parallel to the hinge axis of the window sash, at the same time as the shaft 18 is displaced outwards in the longitudinal direction of the hole 19. Thus occurs the inclined position of the turning handle 15 shown in the open position of the window.

Figure 4:
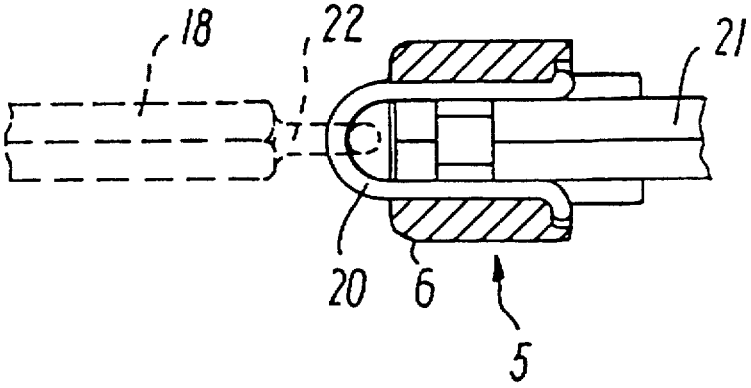

The articulated joint between the shaft 18 and the Venetian blind adjusting mechanism 5 is shown in FIG. 4. The rotary element or the bushing 6 is together with a shackle 20 inserted over one -end of a shaft 21 and retained by means of a locking screw (not shown) which enters into a groove on the shaft 21. The shaft 21 forms part of the adjusting mechanism and is at its other end connected with an angle gear (not shown) for transmission of the rotation to the Venetian blind slats 4*a*. The very structure and operation of the mechanism 5 are known and will not be explained further here.

The shackle 20 is interlocking a loop 22 at the end of the shaft 18 and the loop 22 transfers a rotating movement of the shaft 18 around its longitudinal axis to the shackle 20 and thus to the shaft 21 and provides this with a rotating movement which is transferred to the angle gear (not shown).

In the following description of other embodiments the same reference numerals as above are used for members of the same kind as in FIG. 3.

Figure 5:
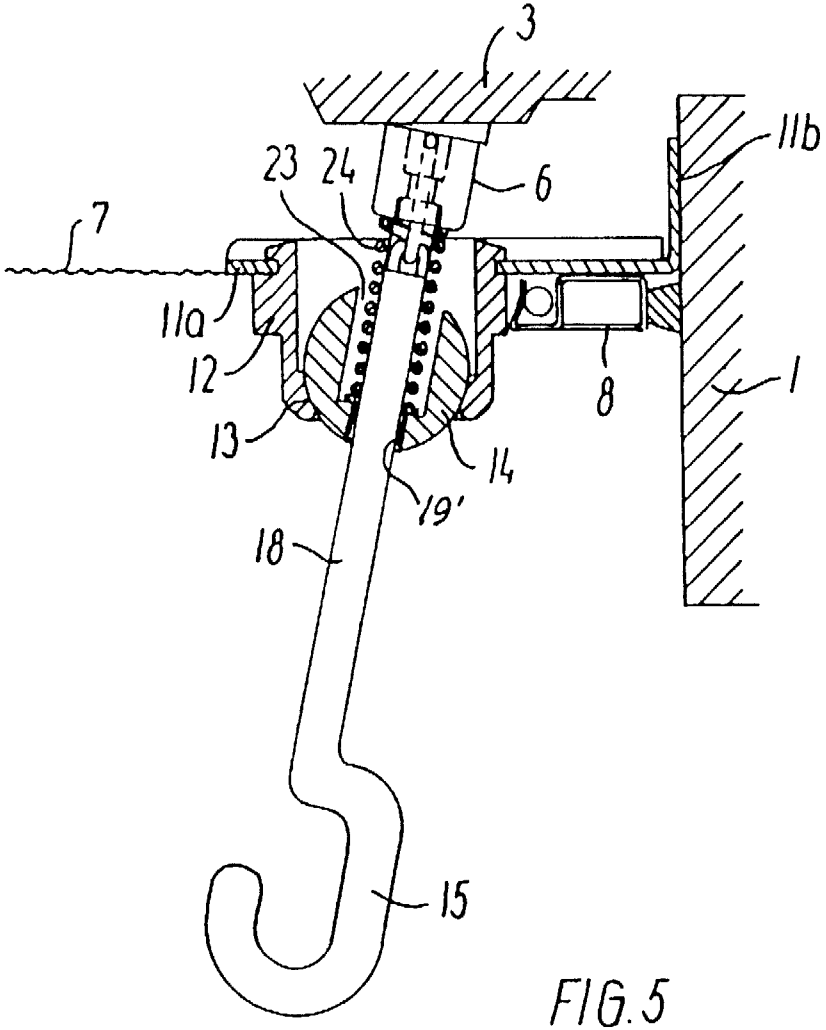

In FIG. 5 is shown an embodiment where the shaft 18 is designed as a round bar and is firmly attached to the turning handle 15. The shaft 18 is displaceable in a circular bore 19' in the ball joint 14 which is here designed as a ball socket with a circular bore 23 adapted to receive a spring 24 resting against the rotary element 6 and serving to keep the ball socket 14 pressed against the lower bearing surface 13 of the bushing 12 during opening of the window, so that a second bearing surface 17 as shown in FIG. 3 can be dispensed with.

Figure 6:
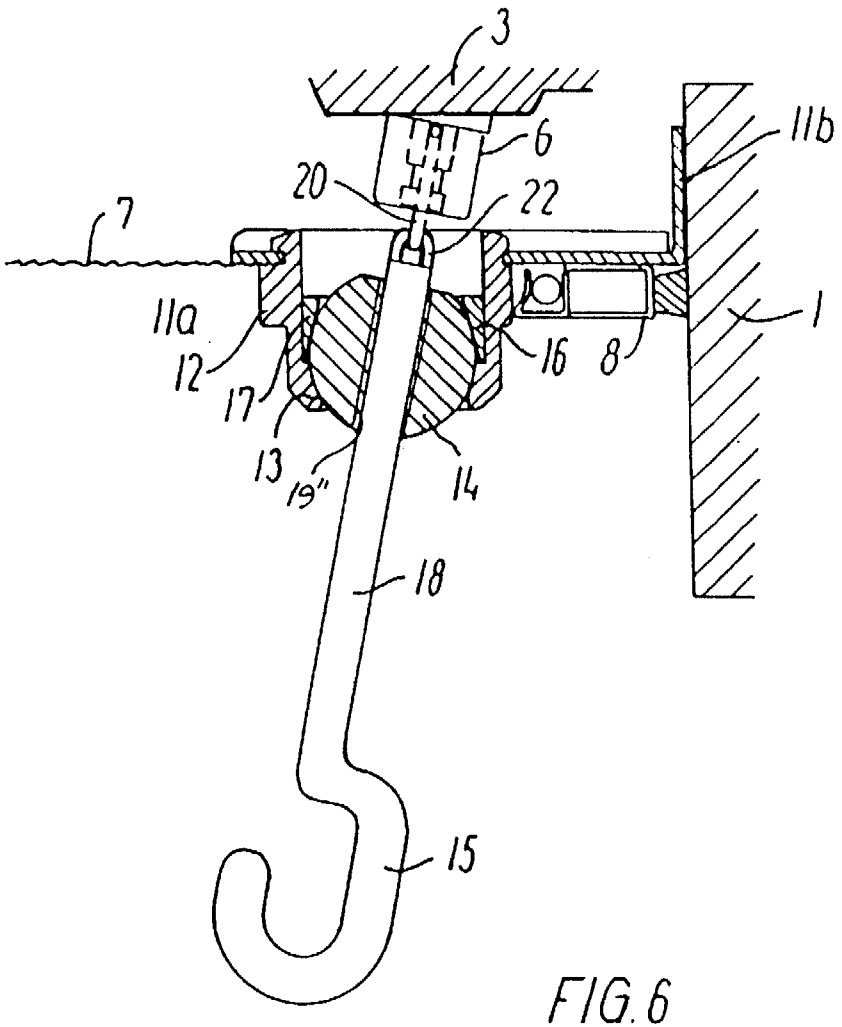

In the embodiment shown in FIG. 6 the bushing 12 is designed as shown in FIG. 3 with first and second bearing surfaces 13 and 17 for the ball joint 14, and the shaft 18 is as in FIG. 5 designed as a round bar formed integrally with the turning handle 15. The shaft 18 is axially displaceable in a circular bore 19" in the ball joint 14, which apart from the bore is designed as a solid ball, resting on the two bearing surfaces 13 and 17.

Figure 7:
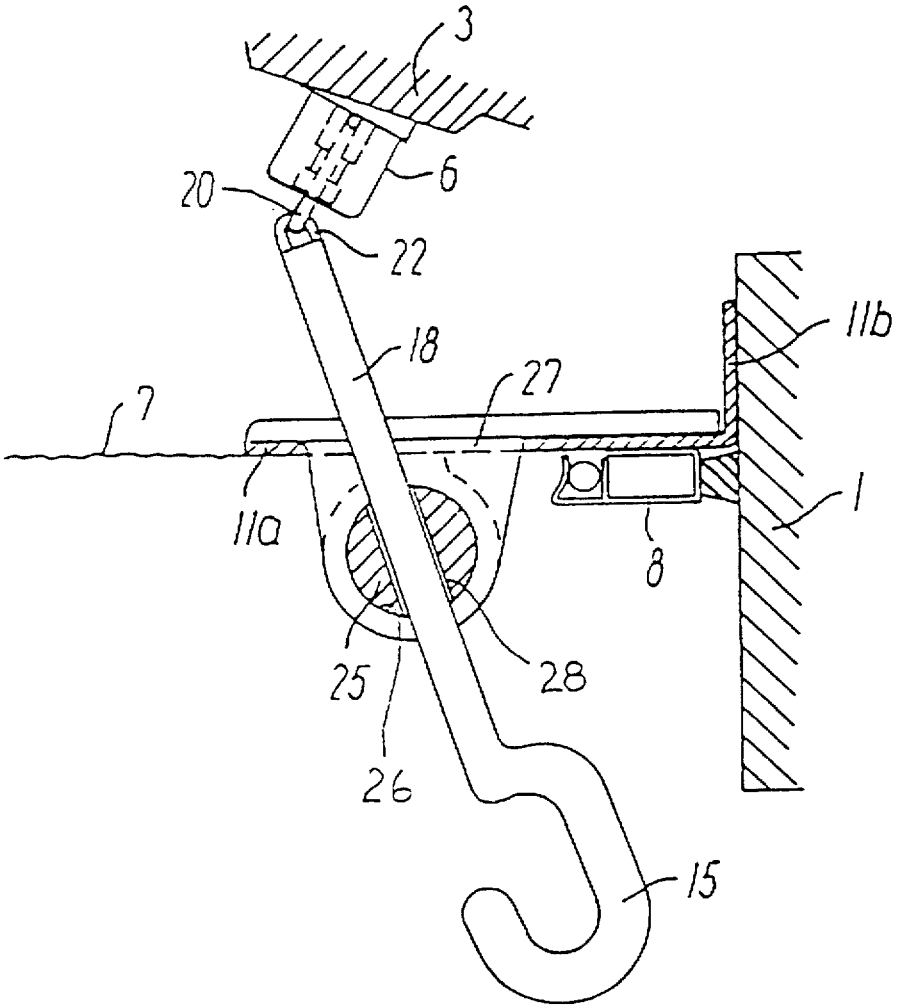

In FIG. 7 is shown an alternative design of the bearing device where instead of a ball joint is used a rotatable cylinder 25 resting in two bearings 26 of which only one bearing is shown in the figure as the section is made immediately on the inside of the other bearing. The bearings 26 are spaced apart in the axial direction of the cylinder 25 so that the cylinder 25 can rotate around an axis parallel to the hinge axis of the window sash. The shaft 18 is also here designed as a round bar passing through a circular bore 28 in the cylinder between the two bearings and formed integrally with the turning handle 15. The bearings 26 are firmly connected to the bracket 11 which via its foot piece 11*a* is fastened to the main frame. The bracket is designed with a hole 27 through which the bar 18 passes. The bearings can also be spaced apart in radial direction of the cylinder where the bearing surfaces partially compass the sides of the cylinder so that the cylinder with the shaft 18 routed through this can rotate around an axis parallel to the hinge axis of the window sash.

This design of the bearing device is simple to manufacture but requires close accuracy when mounting as the cylinder will generally not be pivotable around another axis than its bearing axis.

By direct manual operation of the window, ie. when the window is placed at a level accessible for the user, the turning handle can be designed as a handle which fits better into the hand than the hooked turning handle shown above. In cases where the window is placed at a level which implies that the window cannot immediately be manually operated and the turning handle is therefore operated via a rod, the turning handle may of course also be designed as a loop in which a hook on the rod engages.

The embodiments described above will be especially applicable for roof windows in rooms with great floor-to-ceiling height as the turning handle here is often coupled direct to a mechanical drive which can be placed near the window. As already stated, with the invention the one and same turning handle is used whether the screening is mounted or not. The invention thus makes it possible to avoid intervention in the mounting of the mechanical/electrical drive when the screening is mounted.

The before said light screen can instead of a Venetian blind naturally also be for instance a roller blind or an awning blind.

I claim:

1. An openable window with a main frame (1) and a sash (3) top-hinged therein, in which sash is mounted a light screen with an adjusting mechanism (5), as well as with a screening device (7, 8) adapted to be detachably mounted in the main frame internally of the sash with respect to a room in which the window is positioned and a turning handle (15) mounted at the internal side of the screening device, which turning handle via a shaft (18) extends through said screening device and is connected with the light screen adjusting mechanism in a rotationally locked manner, characterized in that said shaft is articulated with the light screen adjusting mechanism and is axially displaceable in a bore (19, 28) in a pivotable member (14) which is journalled in a bearing device (12) rigidly connected with the main frame in such a way as to permit said shaft to pivot around an axis of rotation parallel to the hinge axis of the window sash.

2. A window according to claim 1, characterized in that said pivotable member (14) is designed as a ball joint, and that said bearing device (12) comprises a double conical bearing (13, 17) in a bearing shell fastened to the main frame.

3. A window according to claim 2, characterized in that said ball joint (14) is designed integrally with said turning handle (15), that said shaft (18) has a non-circular cross section and that said bore is formerly a corresponding non-circular hole (19) in the ball joint and the turning handle.

4. A window according to claim 2, characterized in that said ball joint (14) is designed as a spring-loaded ball socket.

5. A window according to claim 2, characterized in that said shaft (18) is designed as a round bar which is fastened to said turning handle (15) and that said bore is formed by a circular bore (19") in the ball joint (14) designed as a solid ball, to allow said shaft to pivot around its axis.

6. A window according to claim 1, characterized in that said pivotable member is designed as a short rotatable cylinder (25), that said bearing device comprises two bearings (26) in connection with the main frame and with their bearing axis parallel to the hinge axis of the window sash, that said shaft (18) is designed as a round bar firmly connected to said turning handle (15) and that said bore is formed by a circular bore (28) in said cylinder between the two bearings, to allow said shaft to pivot around its axis.

7. A window according to claim 1, characterized in that the articulation between said shaft (18) and the light screen adjustment mechanism (5) comprises a universal joint.

8. A window according to claim 2, characterized in that the articulation between said shaft (18) and the light screen adjustment mechanism (5) comprises a universal joint.

9. A window according to claim 3, characterized in that the articulation between said shaft (18) and the light screen adjustment mechanism (5) comprises a universal joint.

10. A window according to claim 4, characterized in that the articulation between said shaft (18) and the light screen adjustment mechanism (5) comprises a universal joint.

11. A window according to claim 5, characterized in that the articulation between said shaft (18) and the light screen adjustment mechanism (5) comprises a universal joint.

12. A window according to claim 6, characterized in that the articulation between said shaft (18) and the light screen adjustment mechanism (5) comprises a universal joint.

13. A window according to claim 1, characterized in that said light screen comprises a Venetian blind.

14. A window according to claim 1, characterized in that said screening device comprises an insect screen.

* * * * *

UNITED STATES PATENT AND TRADEMARK OFFICE

CERTIFICATE OF CORRECTION

PATENT NO. : 5,782,281

DATED : July 21, 1998

INVENTOR(S) : Brent Møller

It is certified that error appears in the above-indentified patent and that said Letters Patent is hereby corrected as shown below:

Column 3, line 22, "glass.30" should read "glass-".

Column 4, line 4, the hyphen before "end" should be deleted.

Signed and Sealed this

Twenty-second Day of September, 1998

*Attest:*

BRUCE LEHMAN

*Attesting Officer*

*Commissioner of Patents and Trademarks*